United States Patent [19]

Stoltefuss et al.

[11] 4,056,284

[45] Nov. 1, 1977

[54] MACHINES FOR USE IN MINING OR TUNNELLING WORK

[75] Inventors: Wilhelm Stoltefuss, Kamen; Herbert Haller, Gelsenkirchen-Buer; Ottocar Hunscher, Altlunen, all of Germany

[73] Assignee: Gewerkschaft Eisenhutte Westfalia, Westfalia, Germany

[21] Appl. No.: 602,166

[22] Filed: Aug. 4, 1975

[30] Foreign Application Priority Data

Aug. 5, 1974 Germany ..... 2437683

[51] Int. Cl.[2] ..... E21C 25/08; E21C 25/68

[52] U.S. Cl. ..... 299/64; 173/43; 299/75

[58] Field of Search ..... 299/64, 75, 77, 78, 299/70; 173/43

[56] References Cited

U.S. PATENT DOCUMENTS

| | | | |
|---|---|---|---|
| 1,987,982 | 1/1935 | Wheeler | 299/64 X |
| 2,229,086 | 1/1941 | Joy | 299/72 |
| 2,327,928 | 8/1943 | Osgood | 299/72 |
| 2,659,585 | 11/1953 | McCallum | 299/75 |
| 3,314,724 | 4/1967 | Tinlin | 299/75 |
| 3,437,382 | 4/1969 | Meissner et al. | 299/64 |
| 3,782,484 | 1/1974 | Martin | 173/43 |
| 3,873,157 | 3/1975 | Stollefuss et al. | 299/64 X |
| 3,929,378 | 12/1975 | Frenyo et al. | 299/64 |

FOREIGN PATENT DOCUMENTS

| | | | |
|---|---|---|---|
| 2,011,727 | 9/1971 | Germany | 299/75 |

*Primary Examiner*—Ernest R. Purser
*Assistant Examiner*—William F. Pate, III
*Attorney, Agent, or Firm*—Sughrue, Rothwell, Mion, Zinn and Macpeak

[57] ABSTRACT

A machine is disclosed which is for use in mining or tunnelling work and employs a beam or arm supporting cutting means and connected through a support structure to a turntable carried by a movable chassis. The turntable is adjustably rotatable about a vertical axis and one or more piston and cylinder units are provided to raise or lower the arm in relation to the support structure. This structure is itself adjustably pivotable in relation to the turntable about a further axis which is generally aligned with the horizontal forward position of the arm i.e. in the direction of advancement of the mining or tunnelling work. In addition part of the structure connected to the arm is also displaceable along this further axis so that the cutting means located at the free end of the arm can be adjusted in respect of a variety of directions. The cutting means is itself composed of cutter rollers driven to rotate about an axis extending laterally of the arm. To convey away material detached by the cutting rollers the chassis has conveyors at its sides and a loading mechanism composed of an oscillating device mounted over a material reception plate or the like disposed beneath the arm is used to transfer the material onto the conveyors.

8 Claims, 4 Drawing Figures

MACHINES FOR USE IN MINING OR TUNNELLING WORK

BACKGROUND OF THE INVENTION

The present invention relates to a machine for use in mining or tunnelling operations.

Machines having a chassis carried by wheels or endless tracks which supports an arm or beam which can be raised, lowered and pivoted sideways are well known in the mining of minerals or ores, e.g. clay or gypsum, and for the driving of tunnels, galleries and other roadways. The beam has a cutting device such as a bladed roller which acts on a working face. The material removed from the face can be conveyed to the rear of the machine by a scraper-chain conveyor incorporated on the beam and discharged onto a further conveyor.

In the known machines of this type it is difficult to effect efficient control of the path or tunnel cut by the machine or to control the shape of walls defining the path or tunnel. For example, it is not possible to produce a smooth arcuately shaped roof or side wall in a tunnel. Normally all walls have planar contours when produced by the prior art machines.

This is sometimes disadvantageous and there is thus a need for an improved form of machine and a general object of this invention is to provide such a machine.

SUMMARY OF THE INVENTION

In its broadest aspect the invention provides a machine for use in tunnelling or mining; said machine comprising a main frame or chassis, cutting means provided at the free end of an arm and means for supporting the rear end of the arm, wherein the arm is pivotable up and down in a generally vertical sense in relation to said support means, the support means is pivotable back and forth in a generally horizontal sense in relation to the chassis and the support means is pivotable about an axis which extends generally in the forward direction of the arm when horizontal and in the direction of advancement of the tunnelling or mining operation performed by the machine.

The invention also provides a machine for use in tunnelling or mining; said machine comprising a main frame or chassis, an arm, cutting means provided at the free end of the arm, support means for the arm, means connecting the arm to the support means for pivoting up and down in a generally vertical sense, means connecting the support means to the chassis for pivoting in a generally horizontal sense about a vertical axis and means permitting the support means to pivot about an axis which extends parallel to the arm when horizontal and in the direction of advancement of the tunnelling or mining operation performed by the machine.

According to the invention there is also provided a machine for use in tunnelling or mining; said machine comprising a main frame or chassis, an arm, cutting means carried by the free end of the arm, support means for the arm, means connecting the arm to the support means for pivoting about a first axis, means connecting the support means to the chassis for pivoting about a second axis perpendicular to said first axis and means for permitting the support means to pivot about a further axis extending perpendicular to the first and to the second axes whereby the cutting means carried by the arm can be brought into various operating positions by pivoting about the said axes.

In accordance with the invention the arm or beam, and hence the cutting means, can be adjusted in respect of a number of pivot axes including an axis extending in the general direction of advancement of the tunnelling or mining work. It is preferable to also make the support means displaceable along its pivot axis extending in the general direction of advancement. The cutting means itself can take the form of two cutter rollers rotatably driven about an axis extending transversally of the arm. This rotational axis can be swung up and down or from side to side, advanced or retracted and brought into various inclined positions in relation to the horizontal. This enables the formation of tunnel or drift walls of different shapes and especially the formation of smooth walls without sharp steps or transitions. Drifts or tunnels with different cross-sectional profiles following linear or curved paths can also be efficiently produced with the machine. It is advantageous to shape the rollers so that each roller has a maximum diameter between its end portions. The outer end portion can be of domed configuration while the inner portion can be of frustoconical configuration.

It is preferred to support the chassis of the machine on endless tracks or the like permitting the movement of the entire machine. Devices resembling feet can be used to selectively clamp the chassis to the floor when the machine is to be operated. This is also advantageous in stabilizing the machine and permitting the latter to work with the minimum of noise due to the absorption of reactive forces.

A unit composed of conveyors and a material receiving means can be carried by the chassis and used to transfer material detached by the cutting means. This unit can be pivoted to permit the receiving means to be raised clear of the floor of a working when the machine is to be moved. Preferably a drive motor or motors and other equipment for propelling the machine and for driving the various movable paths thereof are all carried by the machine.

A turntable, constituting the means connecting the support means to the chassis, can be mounted on the chassis for rotation about a vertical axis. Preferably there is also provided means connecting the support means to the turntable to permit the support means to move along said pivot axis in the direction of advancement, means for pivoting the arm, means for pivoting the turntable, means for pivoting the support means and means for displacing the support means along said pivot axis.

In accordance with one constructional form, the support means can have a cylindrical part which adjoins a bifurcated end portion supporting a pivot spindle for the arm or beam. One or more piston and cylinder units can be contained within the cylindrical portion and connected to a lower side of the arm and to the interior of the cylindrical portion. The pivot spindle would be located above the pivot axis of the support means extending in the direction of advancement while the connection between the unit or units used to raise or lower the arm and the lower side of the arm would be located below this pivot axis. The cylindrical portion of the support means can itself be located within a hollow body or drum rotatably supported on the turntable for rotation about the aforesaid pivot axis. A suitable coupling provided between the cylindrical portion of the support means and the hollow body can rotatably lock these components together while at the same time permitting relative axis displacement of the support means along the body.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
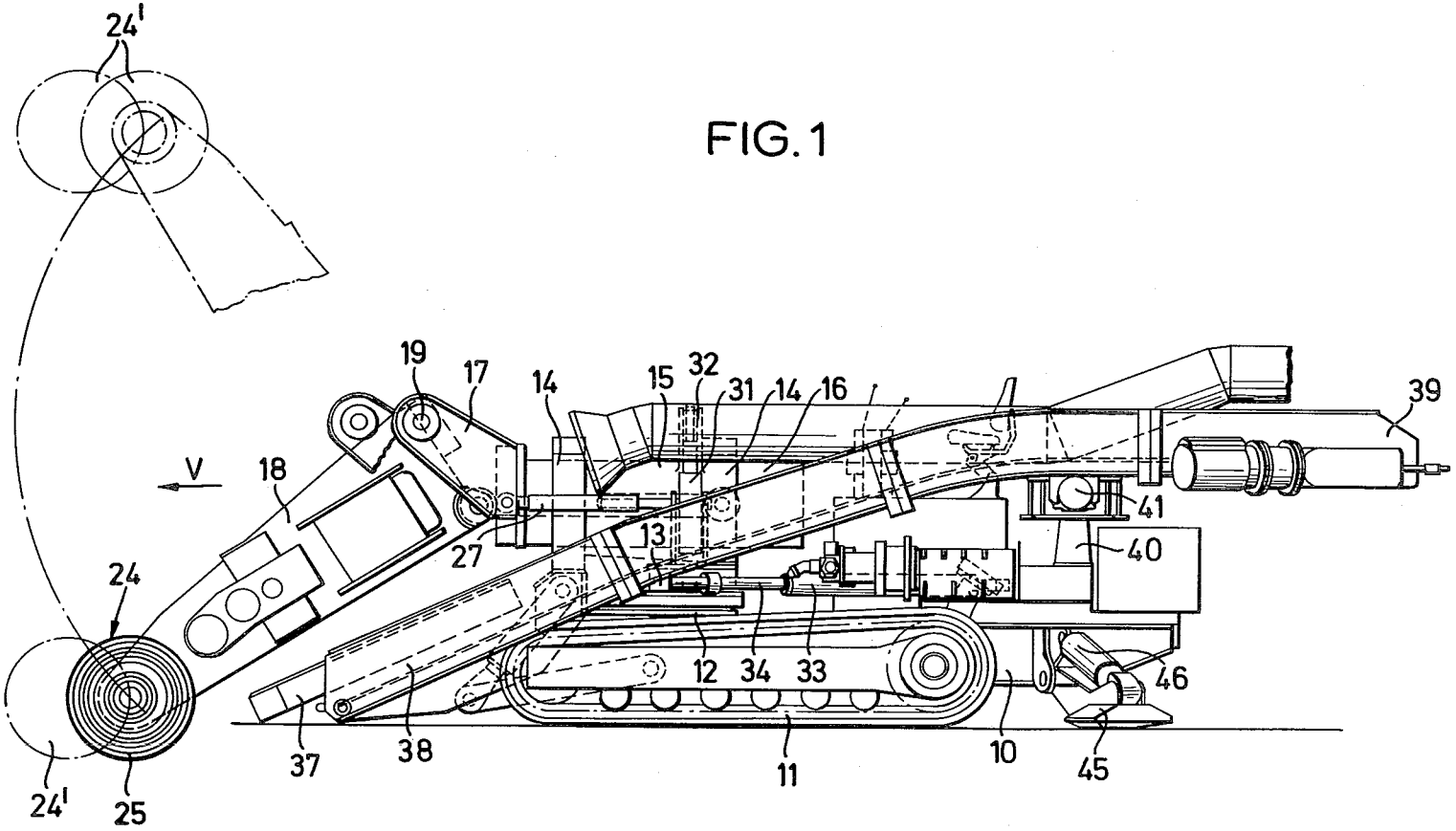
FIG. 1 is a schematic side view of a machine made in accordance with the invention.
Figure 2:
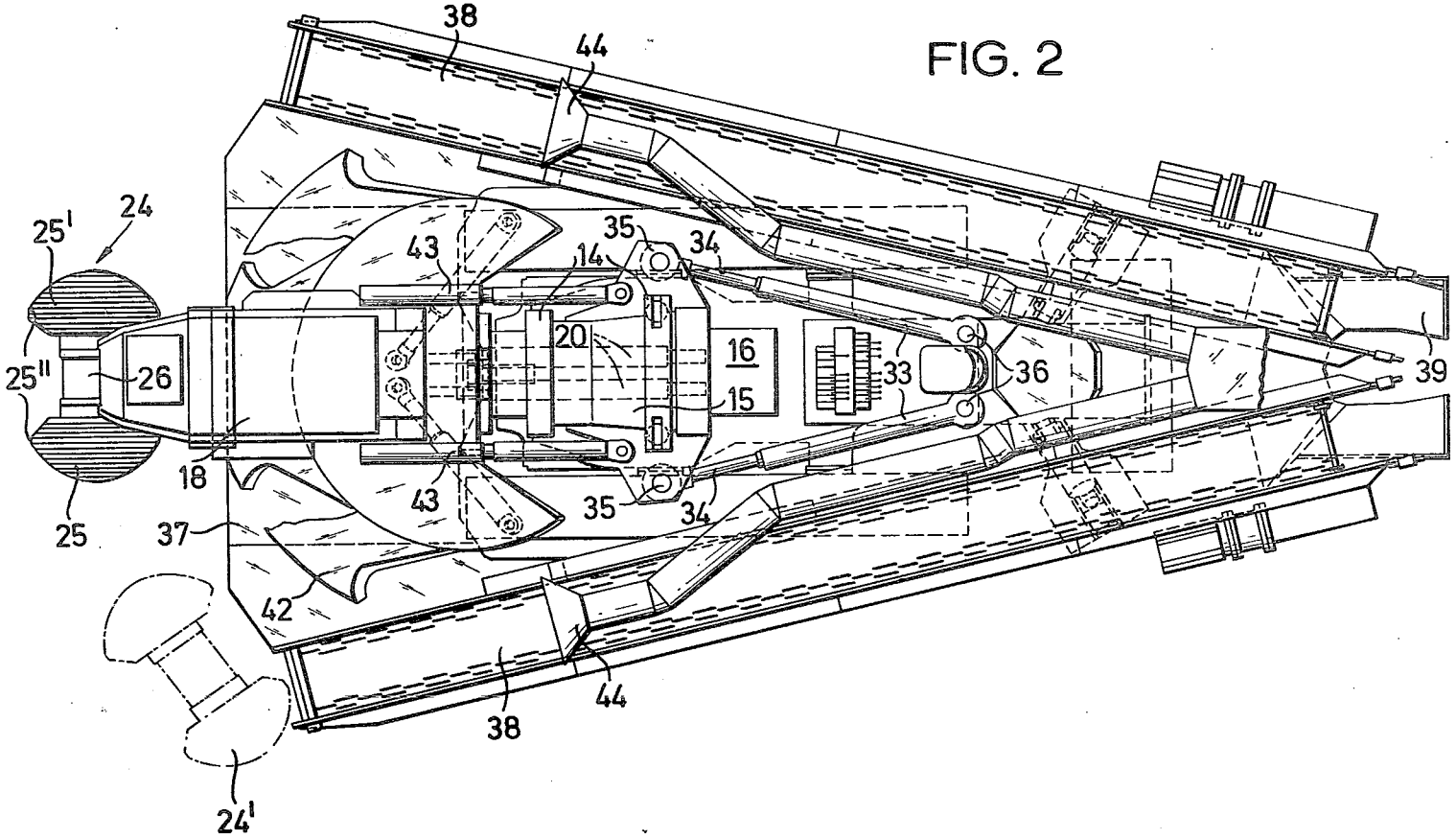
FIG. 2 is a plan view of the machine shown in FIG. 1.

As shown in FIGS. 1 and 2, the overall machine has a main chassis of frame 10 which is supported for movement by means of endless tracks 11, e.g. Caterpillar (R.T.M.) type tracks, which engage on the floor of a mine or tunnel working for example. These tracks 11 can be driven by means carried by the chassis 10 to propel the entire machine and the tracks 11 are preferably operable independently to allow the machine to be steered. In addition, the chassis 10, or parts connected therewith, carries one or more drive motors, hydraulic pumps and other auxiliary equipment necessary for operating the various units of the machine so that the machine is effectively self contained. An operator drive station for controlling the machine can also be provided. The chassis 10 also carries a turntable 12 which is rotatable about a vertical axis. Means, in the form of two piston and cylinder units 33, is provided to move the turntable 12 about its rotational axis. As shown in FIG. 2, these units 33 are inclined in plan view to converge towards the rear of the machine. The cylinders of the units 33 are connected by articulated connections or joints to the chassis 10 or a component rigidly affixed thereto. Each unit 33 has a piston rod 34 also connected through an articulated connection or joint 35 to a suitable lateral projection of the turntable 12. In this construction, a platform 13 is mounted on the turntable 12 to move therewith although the platform 13 and turntable 12 can be combined as a single component.

A cutting means 24 is carried at the free end of an elongate arm or jib 18 which is mounted to the turntable 12 and platform 13 through a support mechanism permitting various adjustments as will be described hereinafter. The cutting means 24, the construction of which is also described hereinafter, serves to detach material from a working face in a manner generally known per se. In order to load and transport the material detached by the cutting means 24 away from the front of the machine, there are provided two scraper-chain conveyors 38 disposed generally at the sides of the machine. At the front end of the machine and beneath the arm 18 and cutting means 24 there is arranged a material receiving means 37 which can take the form of a shaped plate or trough. This means 37 can rest on the floor of the working and is connected to the conveyors 28 so as to form a constructional unit therewith. As shown in FIG. 1, the conveyors 38 are each inclined to ascend in the rearward direction. Each conveyor 38 has an elevated rear end portion 39 from which material is discharged into a further conveyor or a container, for example. As shown in FIG. 2, the conveyors 38 ar also inclined in plan view, at a similar angle to the units 33, to converge at the rear so that the rear end portions 39 are adjacent to form a common discharge zone. A drive means for each conveyor 38 can be located at the rear end portion 39 thereof.

The chassis 10 is provided with an upstanding pillar 40 which serves as a support for the unit composed of the conveyors 38 and the receiving means 37. The unit 37, 38 is pivotably connected to this pillar 40 by means of a suitable bearing 41. Some form of adjusting device, such as one or more hydraulic piston and cylinder units, (not shown) can thus be used to swing the unit 38, 39 about the bearing 41 so as to raise or lower the front end of the receiving means 37 in relation to the floor. When the machine is travelling, the unit 38, 37 would be adjusted to raise the receiving means 37 and some form of locking mechanism, mechanical or otherwise, can be provided to maintain the receiving means 37 in its raised position. In order to transfer and load material collected by the receiving means 37 into the conveyors 38, a loading device 42 is provided. This device 42 is mounted to move over the upper face of the receiving means 37 to push material thereon alternately onto the conveyors 38. The device 42 is oscillated back and forth during operation by means of a pair of hydraulic piston and cylinder units 43 which take an inclined position as depicted in FIG. 2.

Dust extractors, which can take the form of known suction apparatus, are mounted over the conveyors 38 and serve to remove dust from the conveyed material.

In order to clamp the machine in a desired operating position, and if necessary to raise the tracks 11 off the floor, there are provided two devices 45 at the front and rear ends of the chassis 10. Each pair of devices 45 acts as bracing feet at the corners of the chassis 10 and can be selectively braced rigidly against the floor or raised into an inoperative position. To brace or raise the devices 45, hydraulic piston and cylinder units 46 are connected, as illustrated, between the chassis 10 and the device 45. The units 46 serve to pivot the device 45 up or down and when the excavation of material takes place the devices 45 are pressed against the floor to relieve the tracks 11 and clamp the machine in position. It is possible to raise the tracks 11 clear of the ground in this way so that the entire machine is mounted on the devices 45. When set in this manner, the excavating work can proceed comparatively quietly and further clamping or bracing is not usually necessary. Conversely, when the machine is to be moved the devices 45 can be lifted to their inoperative position and the receiving means 37 is also raised. According to the progress of the excavating work the machine would be moved up towards the working face from time to time in the manner described.

Figure 3:
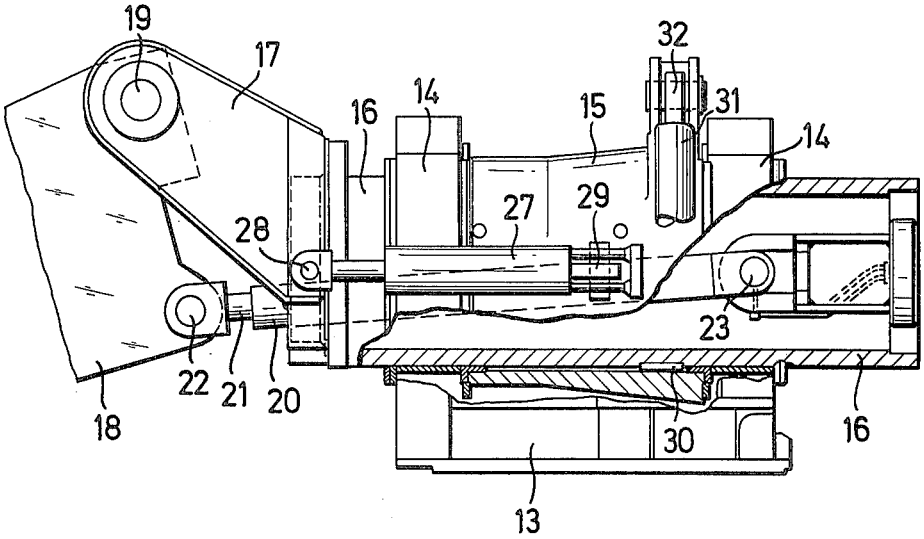
FIG. 3 is a part-sectional side view of the cutting means supporting mechanism of the machine, the view being on a somewhat larger scale.
Figure 4:
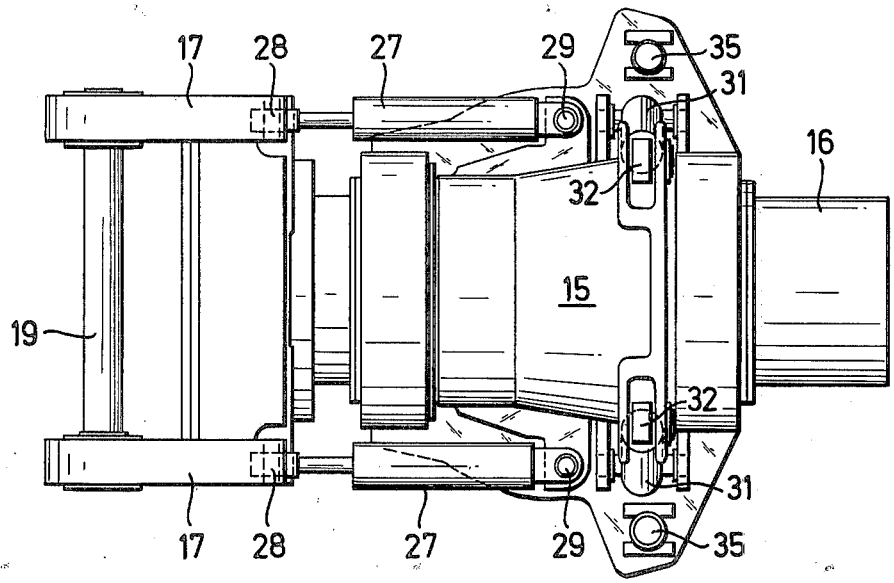
FIG. 4 is a plan view of the part of the machine shown in FIG. 3.

The support mechanism for the arm 18 will now be described. As shown in FIGS. 3 and 4, the platform 13 and turntable 12 assembly has two parallel upstanding structures 14 which are formed with bearings for receiving a drum-shaped hollow body 15. This body 15 can be rotated or partly rotated, i.e. pivoted, about an axis defined by the bearings of the structures 14. This pivot axis for the body 15 is substantially horizontal and parallel to the longitudinal axis of the machine and to the arm 18, when the latter is horizontal and aligned with the direction of advance of the excavating work denoted V in FIG. 1.

In order to displace the body 15 about its pivot axis means, in the form of hydraulic piston and cylinder units 31, is provided. Each unit 31 is inclined in relation to the vertical to taper towards the central plane of the machine in an upward direction. Each unit 31 has its piston rod articulated by a connection to a radial lug on the exterior of the body 15. Similarly, the cylinder of each unit 31 is connected directly or indirectly with the bearing structures 14.

A further support member 16, which constitutes the main support means for the arm 18, has a cylindrical body portion mounted coaxially within the body 15 and projecting therethrough. The body 15 and the member 16 are coupled together in a manner described hereinafter. The forward end portion of the member 16 is provided with a fork-like connection bracket 17 which locates a pivot spindle 19. The support arm 18 is connected for pivoting to the spindle 19. Hence the arm 18 can pivot about an axis, i.e. of the spindle 19, which can be arranged substantially horizontal to extend transversally of the machine and perpendicular to the direction of advance V. The spindle 19 and hence the pivot axis for the arm 18 is offset vertically upwards from the axis of the body 15 and the member 16 and above the longitudinal axis of the arm 18.

Means is provided to raise and lower the arm 18 by pivoting the latter about the axis of the spindle 19. This means takes the form of two hydraulic piston and cylinder units 20. Each unit 20 has its cylinder predominantly within the support member 16 and articulated thereto by means of a connection 23. Each unit 20 has its piston rod 21 likewise articulated to the lower side of the arm 18 by means of a connection 21 disposed below the axis of the body 15 and the member 16 and below the longitudinal axis of the arm 18.

The support means or member 16 is rotatable with the body 15 so that by operating the units 31 the spindle 19 can adopt various positions inclined to the horizontal.

The support means or member 16 and hence the arm 18 can also be advanced in relation to the body 15 and the chassis 10 in the direction of advance V or retracted in the reverse direction. This operation is effected by adjustment means in the form of two hydraulic piston and cylinder units 27 which act on the support member 16. The units 27 are disposed parallel to the pivot axis of the body 15 and the member 16 and each unit 27 has its cylinder articulated to the body 15 by a connection 29. Each unit 27 has its piston rod articulated to the bracket portion 17 of the member 16 by a connection 28.

The coupling between the body 15 and the member 16 permits relative axial displacement therebetween but rotatably locks the body 15 to the member 16. Thus whatever relative axial position the member 16 adopts any pivoting motion of the body 15 is transferred to the member 16. The coupling between the components 15, 16 can take a variety of forms and by way of example a splined connection comprising one or more teeth or splines 30 on the exterior of the member 16 each engaging in a groove in the interior of the body 15 or vice versa can be employed.

Preferably, as shown in FIG. 3, the spline or splines 30 extend over an axial length of the member 16 which is considerably smaller than the overall length of the member 16.

By synchronizing the operation of the units 31, 27 the support member 16 can be advanced axially (arrow V) and pivoted about the arrow V to bring the arm 18 into a variety of desired positions and the units 20 can also separately or simultaneously raise or lower the arm 18. These movements can be supplemented by advancement of the machine as a whole on the tracks 11 and by swinging of the turntable 12 by means of the units 33 which results in a swinging movement of the arm 18 through a horizontal transverse arcuate path.

The cutting means 24 mounted at the free end of the arm 18 takes the form of two cutting rollers 25, 25′ or drums fitted with cutting tools on their exterior surfaces. As shown in FIG. 2 the rollers 25, 25′ are mounted at the ends of a driven shaft or cross-piece 26. The drive system for driving the shaft 26, and hence the rollers 25, comprises a motor and gearing and by making the arm 18 hollow at least part of this drive system can be accommodated within the arm 18. The rollers 25, 25′ themselves each have a frusto-conical portion adjoining the shaft 26 and a dome exterior portion so that overall the shape of the rollers 25, 25′ resembles a mushroom top. The maximum diameter 25″, of each roller 25, 25′ is therefore somewhat centralized so that each roller 25, 25′ tapers radially inwards in both axial directions, i.e. towards and away from the shaft 26. The cutting tools can be provided over all the exterior surfaces of the rollers 25 thereby providing adequate cutting capabilities for whatever setting of the arm 18. The shape of the rollers 25 is also useful where the machine is to excavate a smooth curved wall, for example a roof. The various adjustment features discussed above enable the rollers 25 to be place whereever desired and by way of example FIGS. 1 and 2 show at 24′ alternative positions for the cutting means 24.

Tunnels or drifting galleries of various sizes and shapes can be produced with the machine as described. It is especially advantageous to be able to produce a slight curve in the course of the tunnel and to be able to produce walls of various shapes.

We claim:

1. A machine for use in tunnelling or mining; said machine comprising a main chassis, an arm, support means for the arm, means connecting the arm to the support means for pivoting up and down in a generally vertical sense, rotary cutting means provided at a free end of the arm, the axis of rotation of the cutting means extending transversely of the arm and generally parallel to the axis of pivoting of the arm and means connecting the support means to the chassis for pivoting in a generally horizontal sense about a vertical axis; said support means being composed of a hollow body, bearing means mounting the hollow body on the connecting means for rendering the support means pivotable about an axis which extends parallel to the arm when horizontal and in the direction of advancement of the tunnelling or mining operation performed by the machine, a support member carrying the arm and extending within the hollow body and key means formed between the body and the support member for rendering the support member non-rotatable in relation to the hollow body while allowing displacement of the support member to extend and retract in relation to the hollow body whereby during operation the arm can be swung up and down and the support member displaced in relation to the hollow body to cause the rotary cutting means to move along a path which is approximately vertical.

2. A machine for use in tunnelling or mining; said machine comprising a main frame, a jib beam, rotary cutting means carried by a free end of the jib beam for rotation about a first axis, support means for the jib beam, said support means being composed of first and second parts with the first part being received with the second part and keyed to the second part for rotation therewith, means for extending and retracting the first part of the support means in relation to the second part thereof, means connecting the jib beam to the first part of the support means for pivoting about a second axis parallel to the first axis, a carriage mounted on the chassis for pivoting about a third axis which is upright and perpendicular to the first axis and means mounting the second part of the support means on the carriage to allow the entire support means and jib beam to pivot about a fourth axis extending mutually perpendicular to the first and third axes and spaced from the second axis.

3. The machine according to claim 2, wherein the means for extending and retracting the first part of the support means causes extension and retraction in a direction aligned with the fourth axis.

4. The machine according to claim 2, wherein the first part of the support means is also hollow and has a forked end portion and wherein there is also provided a pivot spindle for the jib beam extending across the forked end portion and defining the second axis which is located above the fourth axis and at least one piston and cylinder unit for pivoting the jib beam in relation to the support means, the piston and cylinder unit being at least partly disposed within the pivot part of the support means and connected to the jib beam and to the support means in such a manner that the connection to the arm is below the fourth axis.

5. The machine according to claim 2, wherein the fourth axis is beneath the second axis.

6. A machine for use in tunnelling or mining operations; said machine comprising a chassis, mobile support means for allowing displacement of the chassis, a turntable mounted on the chassis for rotation about a vertical axis, at least one hydraulic ram for effecting said rotary mobement of the turntable, a hollow body mounted on the turntable for pivoting about a horizontal axis directed generally forwardly of the chassis in the direction of advancement of a tunnelling or mining operation, at least one hydraulic ram for pivoting the hollow body, support means mounted partly within the hollow body, key means rendering the support means non-rotatable but axially displaceable in relation to the hollow body, at least one hydraulic ram for axially extneding and retracting the support means in relation to the hollow body, a jib beam mounted to the support means for pivoting up and down about a horizontal axis perpendicular to the pivot axis of the hollow body, at least one hydraulic ram for pivoting the jib beam and rotary cutting means mounted for rotation about a horizontal axis at the free end of the jib beam.

7. A machine according to claim 1, whrein the cutting means is in the form of rollers having cutting tools thereon, and wherein each roller has a maximum diameter intermediate its end portions.

8. A machine according to claim 1 and further comprising conveyors disposed at the sides of the chassis, a material receiving means for receiving material detached by the cutting means, and a loading device for transferring material from the receiving means to the conveyor in alternation, wherein the conveyors and the receiving means are connected and arranged to form a constructional unit pivotably supported on the chassis so that the receiving means can be raised and lowered.

* * * * *